US008251505B2

(12) United States Patent
Hara

(10) Patent No.: US 8,251,505 B2
(45) Date of Patent: Aug. 28, 2012

(54) RECORDING APPARATUS AND METHOD OF ADJUSTING TEMPERATURE OF TRANSPORT BELT OF RECORDING APPARATUS

(75) Inventor: Keiji Hara, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 450 days.

(21) Appl. No.: 12/409,296

(22) Filed: Mar. 23, 2009

(65) Prior Publication Data

US 2009/0237478 A1 Sep. 24, 2009

(30) Foreign Application Priority Data

Mar. 24, 2008 (JP) ..... 2008-075311

(51) Int. Cl.
*B41J 2/01* (2006.01)

(52) U.S. Cl. ..... 347/102; 347/101; 347/104; 347/17; 347/18; 347/19

(58) Field of Classification Search ..... 347/104, 347/102, 17–19, 101
See application file for complete search history.

(56) References Cited

U.S. PATENT DOCUMENTS

| | | | | |
|---|---|---|---|---|
| 6,879,333 | B2 * | 4/2005 | Furuyama | 347/208 |
| 2005/0195264 | A1 * | 9/2005 | Sootome et al. | 347/104 |
| 2008/0018690 | A1 * | 1/2008 | Nishida | 347/18 |
| 2008/0211895 | A1 * | 9/2008 | Nishino | 347/104 |

FOREIGN PATENT DOCUMENTS

| | | |
|---|---|---|
| JP | 11-277725 | 10/1999 |
| JP | 2005-288905 | 10/2005 |
| JP | 2006-212804 | 8/2006 |
| JP | 2008-044367 | 2/2008 |

* cited by examiner

*Primary Examiner* — Matthew Luu
*Assistant Examiner* — Henok Legesse
(74) *Attorney, Agent, or Firm* — Workman Nydegger

(57) ABSTRACT

A recording apparatus includes a transport belt that transports a target, a record head that performs recording by adhering liquid to the target that is loaded on the transport belt so as to be transported, a heating unit that heats the transport belt so as to accelerate drying the liquid that is recorded on the target by the record head, and a cooling unit that forcedly cools a portion of the transport belt that is heated by the heating unit in a position located in the middle in moving the portion of the transport belt to a position corresponding to the record head.

8 Claims, 4 Drawing Sheets

RECORDING APPARATUS AND METHOD OF ADJUSTING TEMPERATURE OF TRANSPORT BELT OF RECORDING APPARATUS

BACKGROUND

1. Technical Field

The present invention relates to a recording apparatus that includes a transport belt for transporting a target and a record head for performing recording for the target and a method of adjusting the temperature of the transport belt of the recording apparatus.

2. Related Art

Generally, in recording apparatuses such as printers, a configuration in which a record head performs printing for a paper sheet that is transported in the transport direction is used. In such a case, when ink is dried late, a dot area may spread due to flow of an ink droplet, a dot may be imbued or mixed with adjacent dots in colors, or the like, and whereby the print image quality deteriorates. Thus, in order to accelerate the process for drying the ink so as to improve the print image quality, various methods have been used.

For example, in JP-A-2005-288905, in order to prevent spread of ink printed by ink jet heads, an image recording apparatus having a spread preventing unit that applies fixing energy has been disclosed.

However, according to the image recording apparatus disclosed in JP-A-2005-288905, heating is performed by using a heater or the like not only during a printing process for improving the print image quality but also during a print stand-by period for preparing the next printing operation. Accordingly, the transport belt is heated all the time. Thus, the record head continuously receives heat from the transport belt even in the print stand-by period, and thereby ink inside nozzles that are open in the nozzle opening surface facing the transport belt has increased viscosity thereof so as to generate clogging of the nozzles. Therefore, there is a problem that inconvenience such as unstable performance of ink discharge or the like occurs.

SUMMARY

An advantage of some aspects of the invention is that it provides a recording apparatus and a method of adjusting the temperature of the transport belt of the recording apparatus that are capable of effectively preventing the record head from being influenced by heat of the heated transport belt to cause a recording defection or the like.

According to a first aspect of the invention, there is provided a recording apparatus including: a transport belt that transports a target; a record head that performs recording by adhering liquid to the target that is loaded on the transport belt so as to be transported; a heating unit that heats the transport belt so as to accelerate drying the liquid that is recorded on the target by the record head; and a cooling unit that forcedly cools a portion of the transport belt that is heated by the heating unit in a position located in the middle in moving the portion of the transport belt to a position corresponding to the record head.

According to the above-described recording apparatus, drying the liquid recorded on the target by the record head is accelerated by heating using the heating unit. In addition, the portion of the transport belt that is heated by the heating unit is forcedly cooled in the position located in the middle of moving the heated portion to the position corresponding to the record head. Accordingly, it is possible to effectively prevent the record head from being influenced by heat of the transport belt to cause a recording defection or the like.

It is preferable that the above-described recording apparatus further includes: a detection unit that detects transport of the target toward a cooling target position of the cooling unit in advance; and a control unit that controls the cooling unit such that a cooling operation is performed by the cooling unit during a period in which the transport of the target is not detected based on the result of detection of the detection unit and the cooling operation of the cooling unit is stopped at least before the target arrives at the cooling target position for a case where the transport of the target is detected based on the result of detection of the detection unit.

In such a case, the control unit controls the cooling unit based on the result of detection of the detection unit. Accordingly, a cooling operation is performed by the cooling unit during a period in which the transport of the target is not detected, and the cooling operation of the cooling unit is stopped at least before the target arrives at the cooling target position for a case where the transport of the target is detected based on the result of detection of the detection unit. As a result, cooling the transport belt by using the cooling unit can be performed without blocking transport of the target.

In addition, it is preferable that the above-described recording apparatus further includes: a temperature detecting unit that detects a temperature of the heated portion of the transport belt; and a control unit that adjusts cooling power of the cooling unit in accordance with a detected temperature detected by the temperature detecting unit.

In such a case, the temperature of the heated portion of the transport belt is detected by the temperature detecting unit, and the cooling power of the cooling unit is adjusted based on the detected temperature. Accordingly, when the transport belt is at high temperature, the transport belt is cooled with high cooling power. On the other hand, when the transport belt is at low temperature, the transport belt is cooled with low cooling power. As a result, the transport belt can be cooled effectively with the cooling power corresponding to the temperature of the transport belt.

In addition, it is preferable that the above-described recording apparatus further includes a second cooling unit that cools the cooling unit, and the control unit adjusts the cooling power of the cooling unit by controlling the second cooling unit based on the result of detection of the temperature detecting unit.

In such a case, as the control unit controls the second cooling unit based on the result of detection of the temperature detecting unit, the cooling unit is cooled by the second cooling unit so as to adjust the cooling power of the cooling unit.

In addition, in the above-described recording apparatus it is preferable that the cooling unit is an airflow blowing unit that performs a cooling operation by blowing airflow to the transport belt and stops the cooling operation by stopping blowing the airflow to the transport belt.

In such a case, the transport belt is cooled by blowing the airflow in the cooling target position. Accordingly, the transport belt can be cooled in a non-contact manner. In this case, transfer of a foreign material such as dust from the cooling unit to the transfer belt that may occur, for example, in a contact-type cooling unit can be prevented. In addition, a cleaning effect of eliminating dust or the like placed on the transport belt by using the airflow can be acquired.

In addition, in the above-described recording apparatus it is preferable that the cooling unit is a contact-type cooling unit that performs a cooling operation by being brought into contact with the transport belt and stops the cooling operation by being separated from the transport belt.

In such a case, in the cooling operation of the contact-type cooling unit, the cooling unit is brought into contact with the transport belt, and the heat of the transport belt is taken away to the cooling unit based on heat conduction through the contact surface. In addition, when the cooling operation of the contact-type cooling unit is stopped, the cooling unit is separated from the transport belt, and thus, heat conduction to the cooling unit through the contact surface is not performed. As a result, the transfer belt can be cooled effectively through the heat conduction.

In addition, it is preferable that the above-described recording apparatus further includes a drive unit that drives the cooling unit to be contacted with or separated from the transport belt. In the case, the control unit controls driving the drive unit such that the cooling unit is brought into contact with the transport belt for performing the cooling operation, and the cooling unit is separated from the transport belt for stopping the cooling operation.

In such a case, when a cooling operation is to be performed, the control unit controls driving the drive unit such that the cooling unit is brought into contact with the transport belt. On the other hand, when the cooling operation is stopped, the control unit controls driving of the drive unit such that the cooling unit is separated from the transport belt.

According to a second aspect of the invention, there is provided a method of adjusting a temperature of a transport belt of a recording apparatus including a record head that performs recording by adhering liquid to a target that is transported by the transport belt. The method includes: heating the transport belt so as to accelerate drying the liquid that is recorded on the target by the record head; and lowering the temperature of the transport belt that rises in the heating of the transport belt in advance before a heated portion of the transport belt arrives at a position corresponding to the record head by forcedly cooling the heated portion of the transport belt in a position located in the middle of moving the heated portion of the transport belt to a position corresponding to the record head. According to the above-described method, advantages that are the same as those of the above-described recording apparatus can be acquired.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the invention will be described with reference to FIGS. 1 to 4.

Figure 1:
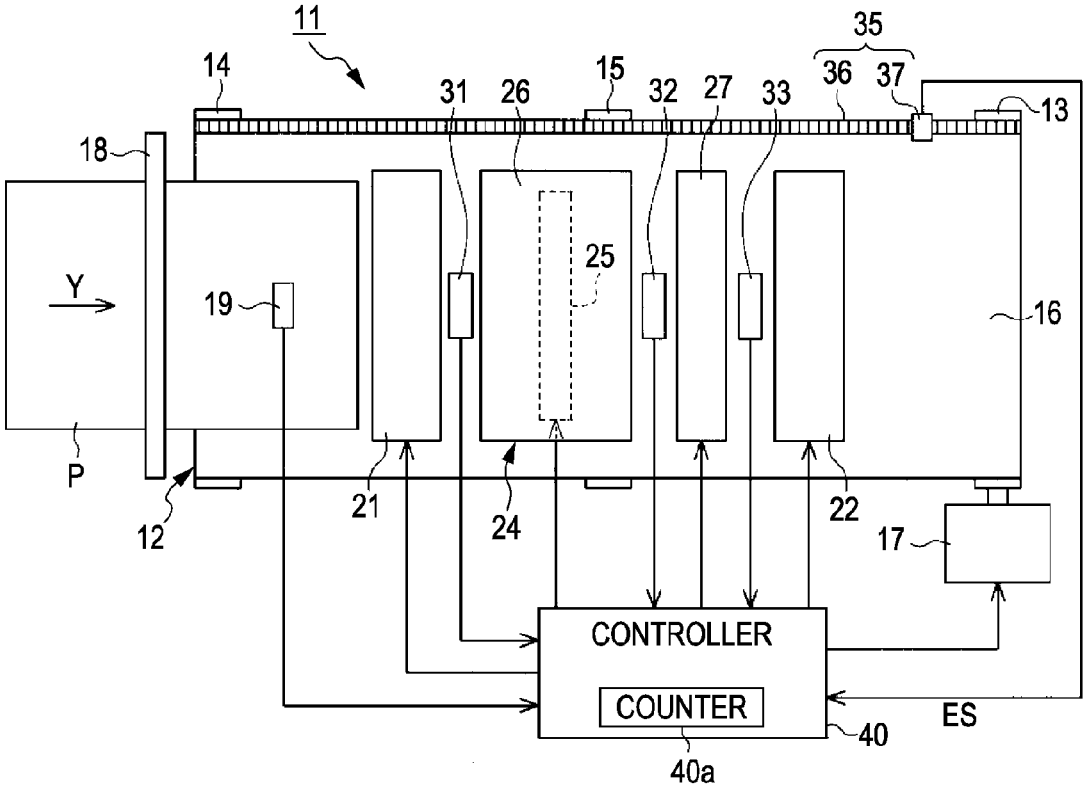
FIG. 1 is a schematic plan view showing the configuration of a printer according to a first embodiment of the invention.
Figure 2:
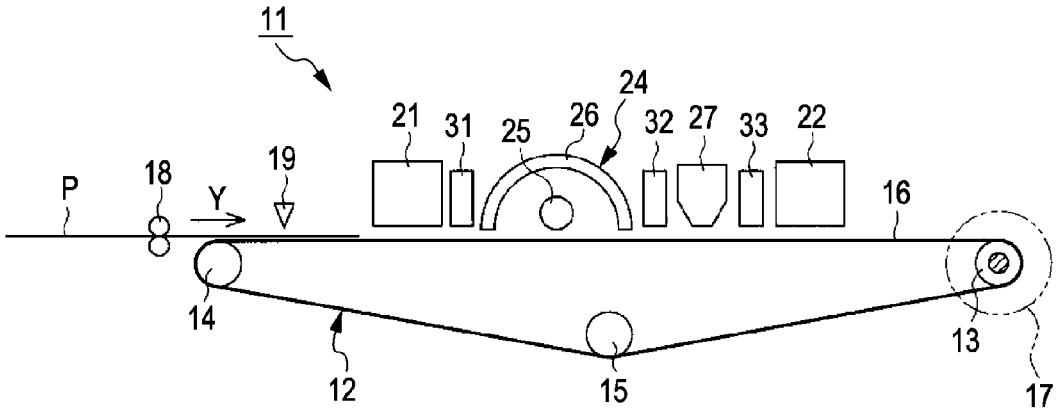
FIG. 2 is a schematic side view of the printer.

FIG. 1 is a schematic plan view of an ink jet line printer. FIG. 2 is a schematic side view of the ink jet line printer. In FIG. 1, the left side is an upstream side in the transport direction of a paper sheet.

As shown in FIGS. 1 and 2, the ink jet line printer (hereinafter, simply referred to as a "printer 11") as a recording apparatus includes a belt transporting device 12 that is used for transporting a paper sheet P as a target. The belt transporting device 12 includes a driving roller 13 that is disposed on the downstream side in the transport direction of the paper sheet, a driven roller 14 that is disposed on the upstream side of the transport direction of the paper sheet, a tension roller 15 that is in an approximately center position between the driving roller 13 and the driven roller 14 and is located on the slightly lower side (see FIG. 2), and an endless-shaped transport belt 16 that is wound around the rollers 13 to 15.

An output shaft of an electric motor 17 (transport motor) is connected to the driving roller 13 directly or through a decelerating mechanism (not shown) for power transmission. When the electric motor 17 is driven to rotate forwardly, the driving roller 13 is driven to rotate, and the transport belt 16 rotates in a direction for transporting the paper sheet P from the upstream side to the downstream side (in FIGS. 1 and 2, from the left side to the right side). On the upstream side of the belt transporting device 12, a gate roller 18 is disposed, and the paper sheet P is fed to the transport belt 16 in accordance with rotation of the gate roller 18. The gate roller 18 corrects skew of the paper sheet P by bumping the paper sheet P into the roller surface thereof. In addition, the gate roller 18 sends out the paper sheet P at a timing for being loaded into a target position located on the transport belt 16 by adjusting the drive starting timing. In a downstream position of the gate roller 18 in the transport direction, a paper detecting sensor 19 that can detect a front end of the paper sheet P that is fed from the gate roller 18 is disposed. In addition, the paper sheet P loaded on the transport belt 16 is configured to be adsorbed to the transport belt 16 by an adsorption unit not shown in the figure. As the adsorption unit, for example, there are a negative-pressure adsorption device that adsorbs the paper sheet P to the transport belt by using a suction force generated by negative pressure through a plurality of suction holes that are formed in the transport belt, an electrostatic adsorption device that adsorbs the paper sheet P to the transport belt in accordance with an electrostatic force by charging electric charges on the transport belt, and the like.

On the upper side of the transport belt 16, a plurality of (in this embodiment, two) record heads 21 and 22 of a line head type having a lengthy shape that are disposed so as to have a direction parallel to the widthwise direction (paper widthwise direction) of the transport belt 16 as its longitudinal direction and are located in a plurality of positions (two positions) with a predetermined distance in the transport direction Y interposed therebetween. The plurality of record heads 21 and 22 are disposed at a height so as to have a predetermined gap from the surface of the transport belt 16. In addition, the plurality of heads 21 and 22 has nozzle rows that are disposed over a range slightly wider than the entire range of a maximum-width paper sheet P in the widthwise direction that can be printed by the printer 11 and are formed of a plurality of nozzles N (see FIG. 3) arranged at a predetermined nozzle pitch on the lower faces thereof. The plurality of record heads 21 and 22 sequentially injects ink at timings adjusted for the paper transporting speed from the nozzles N, and whereby printing an image or the like on the paper sheet P is performed. In descriptions below, between the plurality of heads 21 and 22, a head that is located on the upstream side in the transport direction may be referred to as an upstream record head 21, and a head that is located on the downstream side in the transport direction may be referred to as a downstream record head 22.

Between the upstream record head 21 and the downstream record head 22 that are disposed with a predetermined distance in the transport direction Y interposed therebetween, a heater device 24 as a heating unit is disposed. The heater device 24 is configured by a heater 25 (heat generating body) and a heat reflecting plate 26 that covers the heater 25 and has a curved shape. In addition, between the heater device 24 and the downstream record head 22, that is, in positions that are located on the downstream side of the heater device 24 in the transport direction Y and are located on the upstream side of the downstream record head 22 in the transport direction Y, a cooling unit and a cooling fan device 27 as a blow unit are disposed.

According to this embodiment, in positions located on front and rear sides (both sides) with the heater device 24 interposed therebetween in the transport direction Y, a first temperature sensor 31 located on the upstream side and a second temperature sensor 32 located on the downstream side are disposed. In addition, in a position located between the cooling fan device 27 and the downstream record head 22, a third temperature sensor 33 is disposed. The temperature sensors 31 to 33 detect temperatures of the transport belt 16 and the paper sheet P in the middle of a transport process. The temperature sensors 31 to 33 according to this embodiment are configured by non-contact type temperature sensors that can detect temperatures without any contact. In this example, for example, infrared temperature sensors are used. When the temperature sensor is configured as a movable type in which the temperature sensor can be separated from the transport belt during a paper transporting process and brought into contact with the transport belt at the time of detecting a temperature, a contact-type temperature sensor may be used.

In addition, in a side edge portion of the transport belt 16, a linear encoder 35 is disposed. The linear encoder 35 is configured by a linear scale 36 that is formed in an endless shape over the entire circumference of the transport belt 16 and a sensor 37. For example, the linear scale 36 is configured by a magnetic linear scale having a band-shaped magnetic recording layer in which magnetic patterns are recorded at a constant pitch. The sensor 37 that is disposed in a position close to the linear scale 36 on the upper side thereof (in FIG. 1, the front side of the paper surface), for example, is configured by a magnetic sensor. The sensor 37 reproduces a magnetic pattern that is recorded in the linear scale 36 and outputs an encoder signal ES having a pulse of a period that is in proportion to the transport speed of the transport belt 16. As the sensor 37 of the linear encoder 35, for example, a magnetic sensor such as a GMR (Giant Magneto Resistive Effect) sensor or an MR (Magneto Resistive Effect) sensor that can output multiple values may be used. Alternatively, a hall element, an MI (magnetic impedance) element, or the like may be used as the sensor 37. The linear encoder 35 is not limited to the magnetic type, and thus, a linear encoder of a light detecting type may be used.

In addition, in the printer 11, a controller 40 as a control unit is disposed. The controller 40 controls driving of the electric motor 17, supplies the encoder signal ES received from the sensor 37 to an internal circuit, and generates a printing reference pulse PTS (injection timing signal) by using the internal circuit. A head driving circuit (not shown) located inside the controller 40 controls injection of ink droplets from the nozzles N of the record heads 21 and 22 at appropriate timings that are adjusted to the paper transporting speed based on print data (raster data) and the printing reference pulse PTS.

To the record heads 21 and 22, ink is supplied from ink cartridges, which are not shown in the figure, as ink supplying sources. To the record heads 21 and 22 of this example, ink of a plurality of color is supplied. For example, ink of three colors (for example, cyan, magenta, and yellow colors) is supplied to the upstream record head 21, and ink of one color (for example, a black color) and clear ink are supplied to the downstream record head 22. For example, a color print image is recorded by ink droplets of three colors injected from the upstream record head 21. In addition, the clear ink is injected to the color print image by the downstream record head 22, and whereby overcoat is performed for the print image. A combination of ink to be injected from the upstream record head 21 and the downstream record head 22 may be changed appropriately. Alternatively, a printing process may be performed by painting with ink of a same color twice by the upstream record head 21 and the downstream record head 22.

Figure 3:
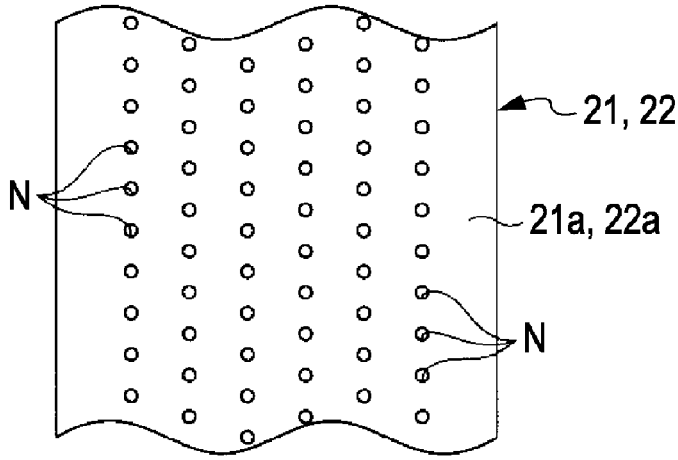
FIG. 3 is a partial schematic bottom view of a record head.

FIG. 3 is a partial bottom view of a record head portion. The record heads 21 and 22 have a same configuration. As shown in FIG. 3, on a nozzle opening surface 21*a* (22*a*) that becomes the bottom face of the record head 21 (22), a plurality of (in this example, six) nozzle rows that are formed by arranging a plurality of (for example, 180) nozzles N that open at a constant nozzle pitch along the paper width direction (in FIG. 3, the vertical direction) is disposed. In two adjacent nozzle rows, the nozzles N are disposed in a zigzag pattern, and ink of a same type is supplied to the nozzles N that configure one set of two rows disposed in the zigzag pattern. Although not shown in FIGS. 1 and 2, ink of corresponding types (for example, color types) is supplied from ink cartridges installed to the printer 11 to the record heads 21 and 22 though tubes.

Figure 4:
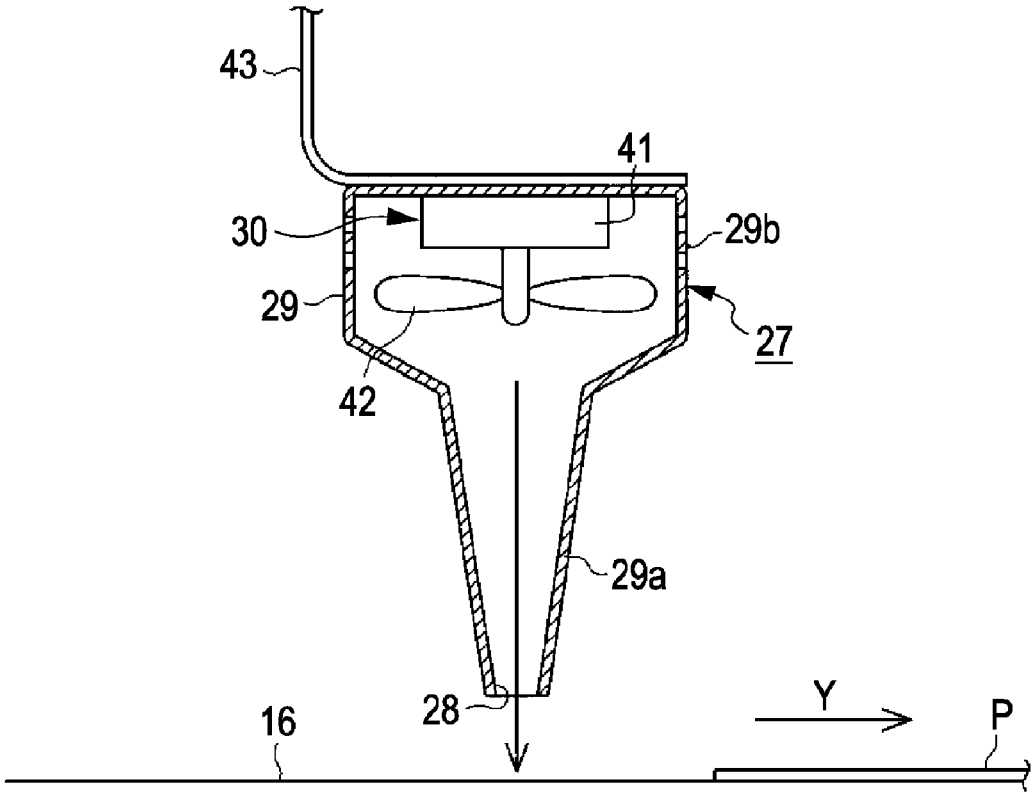
FIG. 4 is a side cross-section view of a cooling fan device according to an embodiment of the invention.

FIG. 4 is a side cross-section view showing the configuration of the cooling fan device. As shown in FIG. 4, the cooling fan device 27 includes a cylinder-shaped guide portion 29*a* having an opening 28, which becomes a blow opening of airflow, in a front end portion (lower end portion), a casing 29 that has a receiving portion 29*b* that is integrally formed on a base end side of the guide portion 29*a*, and a fan device 30 that is housed in the receiving portion 29*b*. The guide portion 29*a* has an approximately flat-plate cylinder shape that extends over a length that is approximately the same as those of the record heads 21 and 22 in the paper width direction (in FIG. 3, in a direction perpendicular to the paper surface). The openings 28 are formed over a range that is slightly longer than the entire range of the paper width of a maximum paper sheet that can be printed by the printer 11. A plurality of the openings 28 may be disposed along the paper width direction.

The fan device 30 includes a fan motor 41 that is fixed to the inside of the housing portion 29*b* and a fan 42 that is installed to the output shaft (rotation shaft) of the fan motor 41. The cooling fan device 27 is supported by the printer 11 through a bracket 43 that is fixed to the back face (the upper face in FIG. 4) of the casing 29. The cooling fan device 27 is positioned at a height so as to dispose the opening 28, which becomes the blow opening, to be separated from the surface of the transport belt 16 by a predetermined distance (for example, a predetermined value in the range of 5 to 20 mm). The cooling fan device 27 forcedly cools the transport belt 16 in a position (cooling target position) located between the heater device 24 and the downstream record head 22 by blowing airflow from the opening 28 to the transport belt 16.

Next, the electrical configuration of the printer 11 will be described. As shown in FIG. 1, to the controller 40, the paper detecting sensor 19, the first temperature sensor 31, the second temperature sensor 32, the third temperature sensor 33, and the linear encoder 35 (in particular, the sensor 37), as an input system, are electrically connected. In addition, to the controller 40, the upstream record head 21, the downstream record head 22, the electric motor 17 for transport, the heater 25 and the cooling fan device 27 (in particular, the fan motor 41), as an output system, are electrically connected. In addition, in the controller 40, a counter 40*a* that counts a counted value representing the position of the paper sheet P in the transport direction Y is disposed. The counter 40*a*, for example, is reset when the paper detecting sensor 19 detects the front end of a paper sheet P. The counter 40*a* counts the position of the paper sheet P in the transport direction Y with the position at the time of reset used as an origin point by counting the number of pulse edges of the encoder signal ES transmitted from the linear encoder 35 after the reset.

The controller 40 according to this embodiment has a CPU (central processing unit), an ASIC (Application Specific Integrated Circuit), memories (ROM and RAM), an input circuit, an output circuit, and driving circuits therein. Inside the controller 40, the control unit that is responsible for controlling the printer 11 may be configured by software that is implemented by CPU's executing a control program that is stored in the memory. Alternatively, the control unit may be configured by hardware that is configured by predetermined logic circuits (custom ICs such as an ASIC or the like), an analog circuit, and the like. Furthermore, the control unit may be configured by cooperation of software and hardware.

Next, a paper transporting process of the printer 11 will be described. When power is input to the printer 11, the heater 25 is electrically conducted by the controller 40, and a conduction current of the heater 25 is controlled based on the detected temperatures of the temperature sensors 31 to 33. As a result, the heater 25 generates heat in a state in which the paper sheet P can be heated to a predetermined temperature.

First, when the paper sheet P is fed, the paper detecting sensor 19 detects the front end of the paper sheet P. When receiving a detection signal from the paper detecting sensor 19, the controller 40 resets the counter 40*a*. Thereafter, the counter 40*a* counts the number of pulse edges of the encoder signals ES that are input from the linear encoder 35. As a result, in the counter 40*a*, the position of the paper sheet P in the transporting direction Y is counted.

Here, the first temperature sensor 31 detects the temperature of the transport belt 16 at a position located on the upstream side of the heater device 24 in the transport direction. The second temperature sensor 32 detects the temperature of the transport belt 16 at a position located on the downstream side of the heater device 24 in the transport direction and the temperature of the paper sheet P in the middle of the transport process. In addition, the third temperature sensor 33 detects the temperature of the transport belt 16 at a position between the heater device 24 and the downstream record head 22 in the transport direction Y. The detected temperature of the paper sheet acquired by the second temperature sensor 32 is used for the controller 40 to determine whether the heating temperature of the heater 25 is a heating temperature at which ink on the paper sheet P can be appropriately dried.

The controller 40 controls the heater 25 in accordance with a setting for which heat needed for improving the print image quality can be supplied to the print-completed paper sheet P based on the detected temperatures of the first temperature sensor 31 and the second temperature sensor 32. In addition, the controller 40 controls the cooling fan device 27 based on the detected temperature of the third temperature sensor 33 such that the transport belt 16 can be cooled up to a temperature at which nozzle clogging of the downstream record head 22 is not generated. A detailed description thereof will be followed below.

First, when a paper sheet P is not transported (during printing stand-by), the controller 40 performs a heater temperature control operation in which the value of a current for conducting the heater 25 is controlled such that a heating temperature, at which a high printing quality can be acquired by appropriately drying the ink, can be acquired, based on the detected temperature Tdet1 of the first temperature sensor 31 and the detected temperature Tdet2 of the second sensor 32.

The temperature condition needed for appropriately drying the ink is that the detected temperature Tdet2 of the second temperature sensor 32 is within a predetermined temperature range Tmin2 to Tmax2. When the detected temperature Tdet2 satisfies the condition of $Tmin2 \leqq Tdet2 \leqq Tmax2$, the current value for conducting the heater 25 is maintained without any change. However, when $Tdet2 < Tmin2$, the current value for conducting the heater 25 is increased. On the other hand, when $Tdet2 > Tmax2$, the current value for conducting the heater 25 is decreased.

In addition, when the detected temperature Tdet1 of the first temperature sensor 31 that detects the temperature of the position located on the upstream side of the heater device 24 in the transport direction is lower than the lower limit threshold value Tmin1 ($Tdet1 < Tmin1$), the controller 40 increases the current value for conducting the heater 25 on a premise that an area near an inlet of the heating area (an area covered with the reflective plate 26) of the heater device 24 has relatively low temperature. On the other hand, when the detected temperature Tdet1 is higher than the upper limit threshold value Tmax1 ($>Tmin1$) ($Tdet1 > Tmax1$), the controller 40 decreases the current value for conducting the heater 25 on a premise that the heating temperature inside the heating area of the heater device 24 is excessively high. Accordingly, the temperature distribution in the transport direction Y inside the heating area of the heater device 24 is appropriate for drying the ink.

In addition, when any paper sheet P is not transported, the controller 40 drives the fan motor 41 of the cooling fan device 27, and thereby airflow is blown from the opening 28 of the guide portion 29*a* to the transport belt 16. At this moment, the controller 40 performs a feedback control process for the fan motor 41 so as to be at a predetermined temperature Ttrg, based on the detected temperature Tdet3 of the third temperature sensor 33 that detects the temperature of the belt in the position located between the heater device 24 and the downstream record head 22. As a result, as the temperature of the belt in the position located between the heater device 24 and the downstream record head 22 is higher than the target temperature, the fan motor 41 rotates at a higher speed, and whereby stronger airflow is blown to the cooling area (cooling target position) that faces the opening 28 of the cooling fan device 27 of the transport belt 16. Thus, when the transport belt 16 passes through the cooling area, the transport belt 16 is cooled in a speedy manner. Here, the target temperature Ttrg is a set temperature at which the belt temperature of a position located right below the downstream record head 22 can be suppressed to a temperature that is equal to or lower than a predetermine temperature at which clogging of the nozzles of the downstream record head 22 can be prevented. Accordingly, even when heating by using the heater 25 is continuously performed for maintaining the transport belt 16 at the predetermined temperature in printing stand-by, the temperature of the belt that is located right below the downstream record head 22 is suppressed to be low by blowing the airflow to the transport belt 16 from the cooling fan device 27. Accordingly, clogging of the nozzles N of the downstream record head 22 does not occur easily. In addition, for the temperature control of the heater 25, feedback control such as PID control may be employed.

Next, when a printing process is started, and a paper sheet P is fed to the transport belt 16, the front end of the paper sheet P is detected by the paper detecting sensor 19, and the position of the paper sheet P in the transport direction Y is counted with the position of the paper sheet at the time of detecting the front end as the origin point in the counter 40*a*. The controller 40 stops driving the cooling fan device 27 in advance before the paper sheet P is sent to the cooling area. In this embodiment, for example, driving the cooling fan device 27 is stopped at a timing when the front end of the paper sheet P passes a half of the heating area of the heater device 24. Accordingly, any airflow is not blown from the cooling fan device 27 to the paper sheet P that comes out of the heating area of the heater device 24, and accordingly, turning-up of the paper sheet P on the transport belt 16 due to the airflow can be avoided. At this moment, heat of the heater device 24 is consumed for heating the paper sheet P and drying the ink. Accordingly, even when the forced cooling of the transport belt 16 is stopped, the temperature of the transport belt 16 does not rise much, compared to the case of non-printing. Thus, the influence of the heat that causes a problem of the downstream record head 22 does not occur.

Then, the controller 40 acquires the transport position of the paper sheet P based on the counted value of the counter 40*a* and drives the cooling fan device 27 again at a timing when the rear end of the paper sheet P passes the area right below the downstream record head 22. As a result, the airflow is blown to the cooling area again, and the temperature of the belt at the time of passing the area right below the downstream record head 22 is low, and accordingly, clogging of the nozzles N of the downstream record head 22 can be avoided effectively. In addition, in this embodiment, as the predetermined position on the transport belt 16 is moved in the transport direction of the transport belt 16, the stages on the transport belt 16 can be acquired in a time series. In such a case, a stage in which the transport belt 16 is heated by the heater device 24 corresponds to a heating stage, and a stage in which the transport belt 16 is cooled by the cooling fan device 27 corresponds to a cooling stage. Then, a cooling stage, in which a portion (heated portion) of the transport belt that is heated in the heating stage is cooled by a cooling unit in an area (cooling area) in the middle of movement toward the recoding position of the record head is set.

As above, according to the first embodiment of the invention, the following advantages can be acquired, as described above.

(1) A configuration in which the cooling fan device 27 as a cooling unit is disposed in a position located on the upstream side of the downstream record head 22 in the transport direction, and the transport belt 16 heated by the heater 25 is cooled in a position located on the upstream side of the downstream record head 22 in the transport direction is used. As a result, clogging of the nozzles N of the downstream record head 22 due to heat transferred from the transport belt 16 can be prevented effectively.

(2) A configuration in which the amount of airflow from the cooling fan device 27 is controlled based on the detected temperature of the third temperature sensor 33 that detects the temperature of the surface of the transport belt 16 is used. Accordingly, compared to a configuration in which the amount of airflow is constant, the temperature of the surface of the transport belt 16 can be decreased in a speedy manner.

(3) A configuration in which blowing airflow from the cooling fan device 27 is stopped when the paper sheet P is transported on the transport belt 16 is used. Accordingly, disadvantages such as turning-up of the paper sheet P in the middle of a printing process due to the blown airflow can be avoided.

(4) The transport belt 16 can be cooled in a non-contact manner. Thus, for example, transfer of dusts (for example, paper powders) from the cooling unit to the transport belt 16 that may happen for a contact-type cooling unit can be prevented. In addition, dusts or the like positioned on the transport belt 16 are blown by the airflow, and whereby a cleaning effect of the transport belt 16 can be acquired. As a result, disadvantages such as contamination of a print image due to attachment of dusts or the like can be avoided.

Second Embodiment

Figure 5:
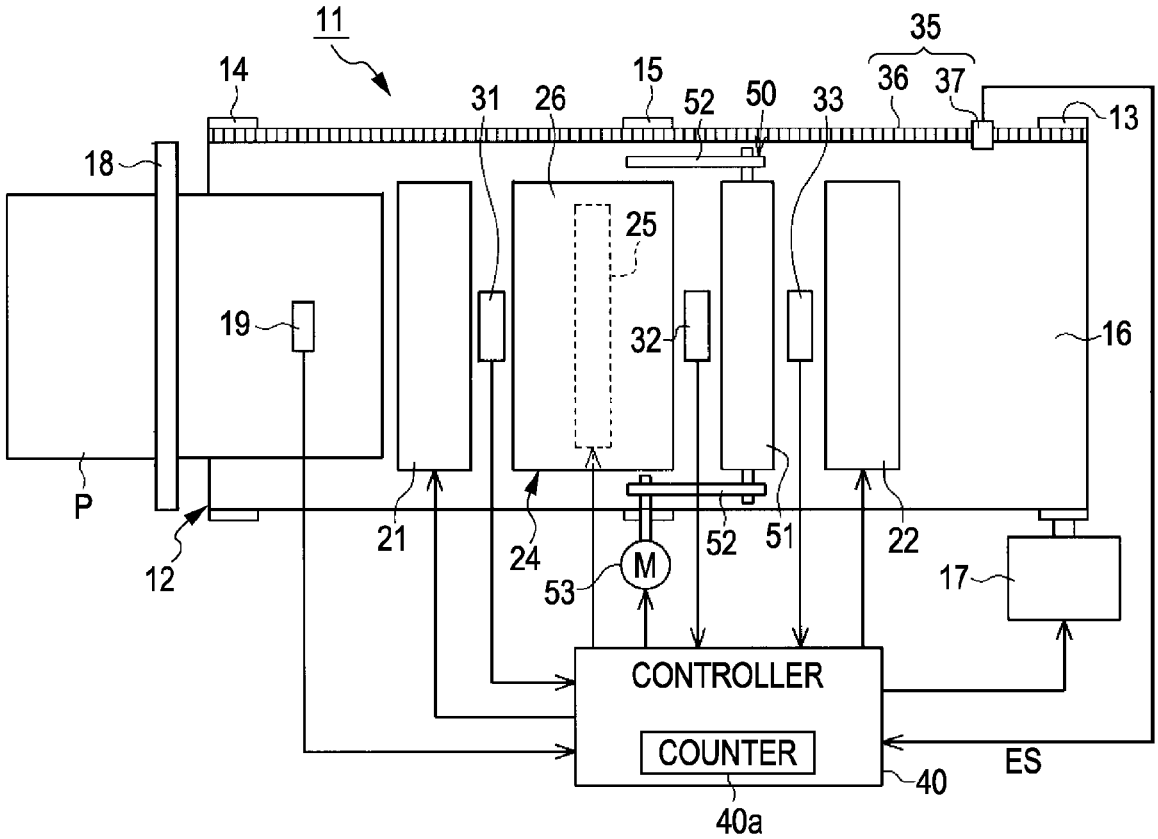
FIG. 5 is a schematic plan view showing the configuration of a printer according to a second embodiment of the invention.

A second embodiment of the invention is a case where a cooling device having a cooling roller instead of the cooling fan device 27 is used as a cooling unit. Hereinafter, the configuration of a printer according to the second embodiment of the invention will be described with reference to FIGS. 5 to 7. To each configuration that is the same as that of the first embodiment, a same reference sign is assigned, and a description thereof is omitted here. Thus, only particularly different points will be described in detail. FIG. 5 is a schematic plan view of the printer according to this embodiment.

As shown in FIG. 5, in the printer 11, a cooling device 50 of a roller type is disposed instead of the cooling fan device 27 shown in FIG. 1. The cooling device 50 includes a cooing roller 51 having a predetermined length in the paper width direction, two arms 52 that support both end portions of the cooling roller 51 in the front end portions thereof in a state in which the cooling roller 51 can be rolled, and an electric motor 53 that rotates one arm 52 around the base end potion in a reciprocating manner. The electric motor 53 is controlled to be driven to rotate by the controller 40.

Figure 6:
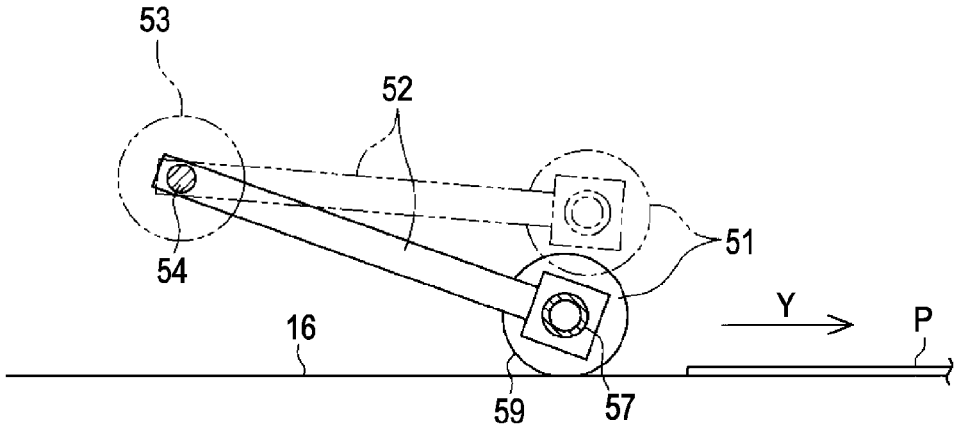
FIG. 6 is a schematic side view showing contacting and separating operations of a cooling roller.

FIG. 6 is a schematic side view showing the operation of the cooling device 50. The cooling roller 51 is configured to be movable between a contact position denoted by a solid line in FIG. 6 and a separation position denoted by a dashed-two dotted line in FIG. 6. In a state in which the cooling roller 51 is in the separation position, when the electric motor 53 is driven to rotate forwardly, the rotation shaft 54 located on the base end side of the arm 52 rotates in the clockwise direction in FIG. 6. Accordingly, the arm 52 rotates around the base end portion in the clockwise direction in FIG. 6, and the cooling roller 51 is disposed from the separation position denoted by the dashed-two dotted line to the contact position denoted by the solid line. On the other hand, in a state in which the cooling roller 51 is in the contact position, when the electric motor 53 is driven reversely, the rotation shaft 54 rotates in the counterclockwise direction in FIG. 6. Accordingly, the arm 52 rotates around the base end portion in the counterclockwise direction in FIG. 6, and the cooling roller 51 is disposed from the contact position denoted by the solid line to the separation position denoted by the dashed-two dotted line.

Figure 7:
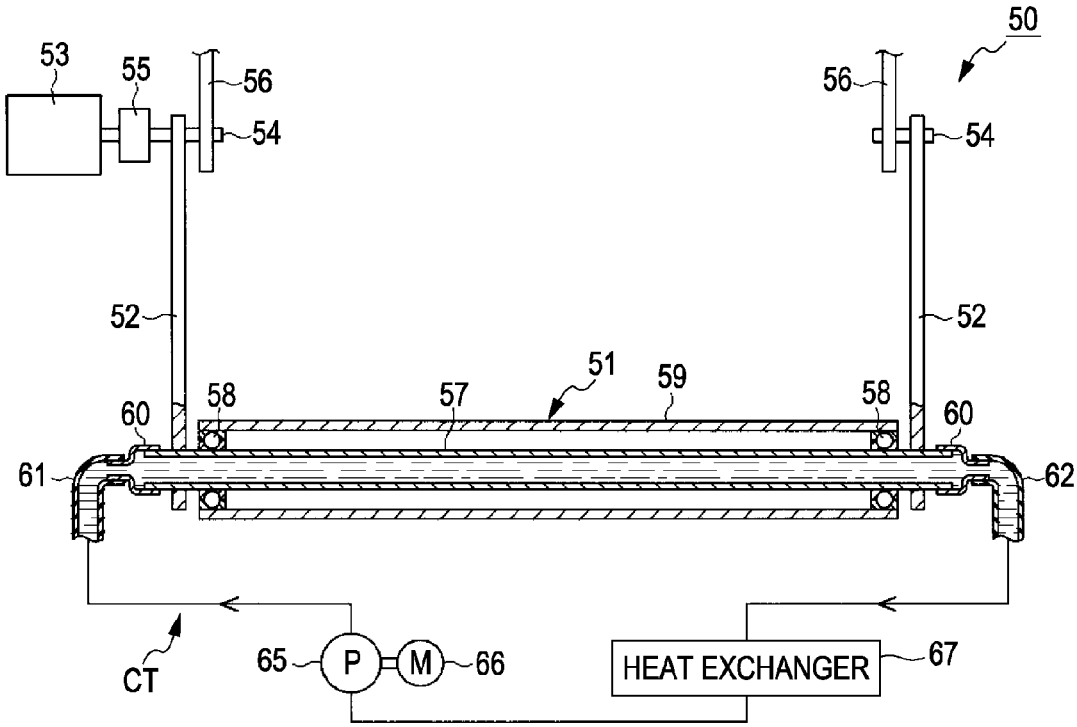
FIG. 7 is a plan view showing a roller-type cooling device in a partial cross-section view.

FIG. 7 shows a detailed configuration of the cooling device having the cooling roller. As shown in FIG. 7, two arms 52 have rotation shafts 54 fixed to base end portions thereof that are supported by frames 56 to be rotatable. As described above, the electric motor 53 has the output shaft connected to the rotation shaft 54 of one arm 52 through the decelerating mechanism 55 for power transmission.

As shown in FIG. 7, the cooling roller 51 has a water-cooling type structure that is cooled by cooling water flowing the inside thereof. The cooling device 50 includes a water-cooling mechanism CT (cooling water circulating mechanism) that cools the cooling roller 51 by using a water-cooling method. In other words, the cooling roller 51 includes a metal support tube 57 forming a pipe shape and a roller part 59 that is supported by the support tube 57 to be rotatable through a metal bearing 58. The roller part 59 is formed of metal having a cylinder shape, and both end side portions of the roller part 59 are closed except for through holes of the support tubes 57. The front end portions of two arms 52 support both end portions of the support tubes 57. In addition, as a metal material of each of the members 57 and 59, for example, aluminum-based metal, copper-based metal, iron-based metal, or the like is used.

To joint tubes 60 that are fixed to both end portions of the support tube 57, tubes 61 and 62 are connected. In FIG. 6, the tube 61 located on the left side is formed as the upstream side of the cooling water, and the tube 62 located on the right side forms the downstream side of the cooling water. The tube 61 located on the upstream side is connected to a discharge opening of a pump 65. The pump 65 is driven by driving a pump motor 66. The cooling water discharged from the pump 65 is warmed by taking heat of the cooling roller 51 away in the process of passing the inside of the support tube 57, and the warmed cooling water is discharged through the tube 62 located on the downstream side. The discharged cooling water is configured to be sent to a heat exchanger 67 through the tube 62. The heat exchanger 67 cools the cooling water by taking heat away from the cooling water.

The cooling water that is cooled by the heat exchanger 67 is supplied to a supply opening of the pump 65. As described above, in the process of flowing of the cooling water discharged from the pump 65 inside the support tube 57, the heat transferred from the roller part 59 to the support tube 57 through the bearing 58 is taken by the cooling water, and whereby the roller part 59 of the cooling roller 51 is cooled. The cooling water discharged from the support tube 57 is cooled by the heat exchanger 67 and then, is discharged from the pump 65 again so as to circulate the inside of the water-cooling mechanism CT. In addition, according to this embodiment, a second cooling unit is configured by a water-cooling mechanism CT that circulates the cooling water in a path by way of the inside of the cooling roller 51.

Next, a paper transporting process of the printer 11 configured as described above will be described. The temperature control of the heater 25 by using the controller 40 is the same as that of the first embodiment.

When any paper sheet P is not transported, the cooling roller 51 is disposed in the contact position in which the cooling roller 51 is brought into contact with the transport belt 16. The controller 40 controls the drive speed of the pump 65 by controlling the rotation speed of the pump motor 66 based on the detected temperature Tdet3 of the third temperature sensor 33, whereby controlling the amount of flow of the cooling water flowing inside the support tube 57 of the cooling roller 51. In order to allow the detected temperature Tdet3 to be close to the target temperature Ttrg, the rotation speed of the pump motor 66 is feedback-controlled. Here, as a difference between the detected temperature Tdet3 and the target temperature Ttrg increases, the pump 65 is driven to rotate at a higher speed. Accordingly, by controlling the amount of flow of the cooling water that flows inside the support tube 57 of the cooling roller 51 based on the difference between the detected temperature Tdet3 and the target temperature Ttrg, the cooling power for taking heat away from the transport belt 16 through a contact surface is adjusted based on the temperature of the transport belt 16. Thus, when passing through the cooling area, the transport belt 16 is cooled in a speedy manner. Accordingly, even in a state in which heating by using the heater 25 is continued for maintaining the transport belt 16 at a predetermined temperature in the print stand-by process, the temperature of the belt that is located right below the downstream record head 22 can be decreased, and therefore a case where the nozzles N of the downstream record head 22 are clogged due to heat transferred from the transport belt 16 in the print stand-by process can be avoided.

Next, when a printing process is started, and a paper sheet P is fed on the transport belt 16, the front end of the paper sheet P is detected by the paper detecting sensor 19, and the position of the paper sheet P in the transport direction Y with the position at the time of detecting the front end of the paper sheet used as the origin point is counted in the counter 40*a*. The controller 40 moves the cooling roller 51 in advance from the contact position to the separation position before the paper sheet P is transported to the cooling area. According to this embodiment, for example, by starting driving of the electric motor 53 reversely at a timing when the front end of the paper sheet P passes through a half of the heating area of the heater device 24, the cooling roller 51 is moved from the contact position to the separation position. Accordingly, contact of the print surface of the paper sheet P with the cooling roller 51 can be avoided.

Then, the controller 40 acquires the transport position of the paper sheet P based on the counted value of the counter 40*a* and starts driving the electric motor 53 forwardly, for example, at a timing when the rear end of the paper sheet P passes though an area located right below the downstream record head 22. As a result, the cooling roller 51 is disposed in the contact position again. Then, as the cooling roller 51 rolls the surface of the transport belt 16, the heat of the transport belt 16 is taken away to the cooling roller 51 through the contact surface. Accordingly, since the temperature of the belt at the time of passing the area right below the downstream record head 22 is decreased, clogging of the nozzles N of the downstream record head 22 can be prevented effectively.

Therefore, according to this second embodiment, the following advantages can be acquired.

(5) A configuration in which the cooling roller 51 as the cooling unit is disposed in a position located on the upstream side of the downstream record head 22 in the transport direction, and the transport belt 16 heated by the heater 25 is cooled in an area (cooling area) between the heater 25 and the downstream record head 22 in the transport direction is used. As a result, the clogging of the nozzles N of the downstream record head 22 due to heat transferred from the transport belt 16 can be prevented effectively.

(6) A configuration in which the driving speed of the pump 65 is controlled based on the detected temperature Tdet3 of the third temperature sensor 33 that detects the surface temperature of the transport belt 16, and the amount of flow of the cooling water of the water-cooling mechanism CT is controlled is used. Accordingly, compared to a case where the amount of flow of the cooling water is fixed, the surface temperature of the transport belt 16 can be decreased in a speedy manner.

(7) A configuration in which the cooling roller 51 is separated from the transport belt 16 for a case where the paper sheet P is transported on the transport belt 16, and the cooling roller 51 is brought into contact with the transport belt 16 for a case where any paper sheet P is not transported to the transport belt 16 is used. Accordingly, cooling the transport belt 16 can be achieved without blocking the transport of the paper sheet P.

(8) A configuration in which the cooling roller 51 is directly brought into contact with the transport belt 16 so as to be cooled is used, and accordingly, heat can be taken effectively, compared to a configuration in which the transport belt 16 is cooled in a non-contact manner. Therefore, the transport belt 16 can be cooled effectively.

In addition, embodiments of the invention are not limited to the above-described embodiments and may be changed as follows.

Modified Example 1

Figure 8A:
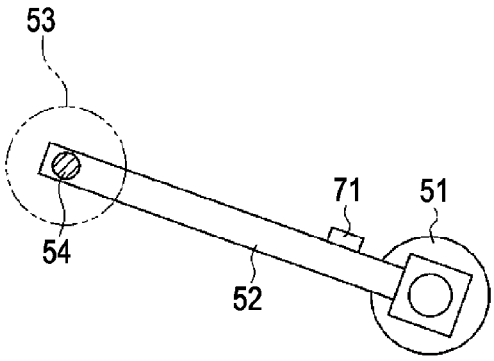
FIGS. 8A and 8B are schematic side views showing the configuration of a roller-type cooling device.

In the above-described second embodiment, the second cooling unit that cools the cooling roller 51 as the cooling unit may be configured by using a method other than the water-cooling method. For example, as shown in FIG. 8A, a configuration in which a cooling element 71 (in this example, a peltiert element) that cools the cooling roller 51 is attached to the arm 52 formed of metal may be used. In such a configuration, the cooling element 71 cools the arm 52, and the heat of the cooling roller 51 is conducted to the arm 52, whereby the cooling roller 51 is forcedly cooled. The controller 40 (see FIG. 5) controls the current value of the cooling element 71 based on the detected temperature that is detected by the temperature sensor 32 and controls the cooling power of the cooling roller 51 indirectly. In particular, as the detected temperature that is detected by the temperature sensor 32 becomes higher, the controller 40 controls the current value of the cooling element 71 to be increased in a stepwise or continuous manner, and whereby controlling the cooling power of the cooling roller 51.

Figure 8B:
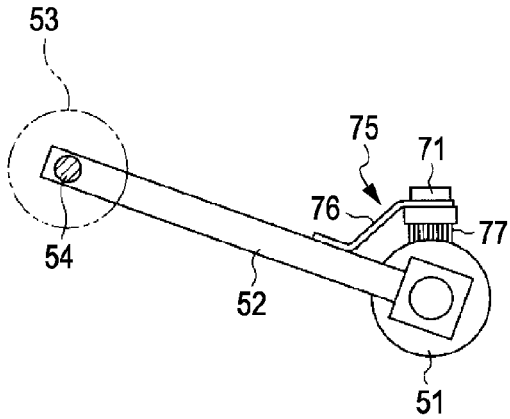

In addition, as shown in FIG. 8B, as the second cooling unit for cooling the cooling roller 51, a brush device 75 may be disposed as the second cooling unit. The brush device 75 has a brush part 77 that is maintained in the front end portion of the support part 76 that is fixed to the arm 52 in a state in which the brush part 77 is brought into contact with the outer peripheral surface of the cooling roller 51. In addition, on the back face (in the figure, the upper side) of the brush part 77, a cooling element 71 is fixed. When the cooling element 71 cools the brush part 77, the heat of the cooling roller 51 is taken away to the brush part 77 that is brought into contact with the outer peripheral surface thereof, and whereby the cooling roller 51 is cooled. The controller 40 (see FIG. 5) controls the current of the cooling element 71 based on the detected temperature that is detected by the temperature sensor 32 and controls the cooling power of the cooling roller 51 indirectly. In addition, the second cooling unit may be a metal roller that is brought into contact with a portion of the cooling roller that is different from a contact position of the transport belt so as to rotate together. In such a case, the pump 65, the heat exchanger 67, and the like are not needed. Accordingly, the configuration of the cooling device 50 can be simplified, compared to the cooling device 50 of the water-cooling type.

Modified Example 2

In the cooling fan device 27 according to the first embodiment, the second cooling unit may be disposed. For example, in the inner portion or the outer portion of the casing 29, a cooling element (for example, a peltiert element) as the second cooling unit may be disposed, or a cooling device such as a water-cooling pin, the inside of which cooling water flows may be disposed in the front or rear position of a fan inside of the casing 29.

Modified Example 3

A position in which the contact-type cooling unit such as the cooling roller is brought into contact with the transport belt is not limited to the target-placing-side surface. For example, a configuration in which the cooling roller is brought into contact with a portion located on the back face side of the transport belt that is opposite to the target-placing-surface side may be used. In such a case, the cooling roller needs not to be separated from the transport belt, and accordingly, the cooling efficiency of the transport belt can be increased. In addition, a contact-type cooling unit such as the cooling roller may be brought into contact within a non-placing area (for example, in a front or rear area of the tension roller 15 in the transport direction in FIG. 2) of the target-placing-surface side of the transport belt in which the paper sheet P is not placed, or an airflow blowing unit such as the cooling fan device that blows cooling wind may be disposed in the non-placing area.

Modified Example 4

A stop timing for stopping the cooling operation of the cooling unit may be set appropriately. For example, a stop timing for stopping the cooling operation of the cooling unit at a time when the paper sheet P is detected by the paper detecting sensor 19 may be used. In addition, as other stop timings, a timing (A) when print data is received from a host device, a timing (B) when a feed operation is started, a timing (C) when a feed operation is completed, a timing (D) when printing is started, or the like may be used. Furthermore, a predetermined time is counted by the timer from the above-described timings may be used as the stop timing. In addition, a start timing for starting the cooling operation of the cooling unit may be set appropriately. For example, the start timing may be a timing (A) when the rear end of the paper sheet P passes through the recording position of the record head, a timing (B) when a paper discharging operation is completed, a timing (C) when it is checked that there is no subsequent print job after completing a paper discharging operation, a timing (D) when a predetermined time is counted by the timer from (C), or the like. In addition, when there is any interval between a previous paper sheet and a next paper sheet, the cooling operation may be performed by utilizing the interval.

Modified Example 5

There may be only one record head that is disposed in the printer 11. In such a case, the heating unit is disposed in a downstream side position of one record head in the transport direction. However, as the heat of the heating unit is gradually accumulated in the transport belt while an endless-shaped transport belt repeats circulation, the temperature of the transport belt becomes high. In such a case, nozzle clogging of the record head due to the heat transferred from the transport belt may occur. However, when the cooling unit is disposed on the upstream side of the record head in the transport direction, nozzle clogging of this type can be avoided. In addition, when the transport belt is a cyclic driving type, the cooling unit is disposed such that a position that becomes the downstream side (that is, the downstream side in the cyclic direction of the belt) of the heating unit in the transport direction and the upstream side of the record head in the transport direction can be cooled. Accordingly, the transport belt is gradually heated to a high temperature during the transport belt circulates can be avoided by cooling the transport belt by using the cooling unit. Therefore, clogging of the record head that occurs due to heat transferred from the transport belt can be prevented. In addition, when there is only one record head, the lower side (the tension roller side) of the transport belt becomes a position located on the upstream side of the recording position in the target transport direction.

Modified Example 6

The refrigerant flowing inside the cooling roller 51 is not limited to cooling water, and known liquid or gas that is used as a refrigerant may be used.

Modified Example 7

Both an airflow blowing unit (a cooling fan device or the like) and a contact-type cooling unit (a cooling roller or the like) may be disposed together. In such a case, between the heating unit and the record head in the transport direction, the units may be disposed.

Modified Example 8

Three or more record heads may be disposed in the transport direction. For example, when there are (N+1) record heads, a record head, a first heating unit, a first cooling unit, a first record head, a second heating unit, a second cooling unit, a second record head, . . . , an N-th heating unit, an N-th cooling unit, and an N-th record head may be arranged in the described order in the belt circulating direction. Among N record heads, in order to prevent clogging of at least one record head, it is sufficient that there is at least one record head (a record head as a nozzle clogging preventing target) arranged in the order of a heating unit, a cooling unit, and the record head. For example, for the purpose of preventing nozzle clogging of a specific record head (for example, a record head in which ink that can be easily dried is used) that is weak for heat, only one set may be configured.

Modified Example 9

The transport device is not limited to a cyclic driving type in which an endless-shaped transport belt is driven cyclically. For example, a configuration in which the transport belt is moved in a straight line in a reciprocating manner for transporting a target may be used. For example, in the forward moving direction, a first heating unit, a record head, and a second heating unit are disposed. In such a case, In the forward moving, paper feed, recording by using a record head, and heating by using a second heating unit are performed. In addition, in the forward moving, paper feed, recording by using a record head, and heating by using the first heating unit are performed. In such a case, although the transport direction is not uniquely determined, when there is a case where a target is transported in a direction from the heating unit toward the record head, the downstream side of the heating unit in the transport direction and the upstream side of the record head in the transport direction can be defined.

Modified Example 10

In the above-described embodiments, a recording apparatus is embodied as an ink jet recording apparatus as a liquid injecting apparatus. However, the invention may be embodied as a liquid injecting apparatus that injects or discharges liquids other than ink (including liquid, a liquid form body in which particles of a function material are dispersed in or mixed with liquid, and a fluid form body such as gel). For example, the recording apparatus may be a liquid form body injecting apparatus that injects a liquid form body including a material such as an electrode material or a coloring material (pixel material) used for producing a liquid crystal display, an EL (electroluminescence) display, a field emission display, or the like in a dispersed or dissolved form, a liquid injecting apparatus that injects a transparent resin liquid such as an ultraviolet-curable resin onto a substrate for forming a tiny hemispherical lens (optical lens) used in an optical communication element or the like, a liquid injecting apparatus that injects etching liquid such as an acid or alkali etching liquid for etching a substrate or the like, or a fluid injecting apparatus that injects a fluid form body such as a gel (for example, a physical gel). In addition, a predetermined pattern (including a wiring pattern, an electrode pattern, a pixel pattern, an etching pattern, and an arrangement pattern) that is formed by landing injected liquid (dot) in a target is included in an image (pattern image) described here that is formed by the image forming apparatus such as the above-described apparatuses, as well. In addition, in the "liquid", for example, inorganic solvent, organic solvent, liquid, liquid resin, liquid metal (metal melted solution) a liquid form body that contains a solid body (a particle or the like), and a fluid body are included. In addition, the invention may be applied to recording apparatuses other than ink jet printers that perform recording by adhering liquid such as ink to a target. For example, the invention may be applied to a recording apparatus that does not inject liquid such as a dispenser-type recording apparatus that discharges one type of liquid in a predetermined length (predetermined amount) without stopping or a coating-type recording apparatus that performs recording by coating liquid to a target.

Hereinafter, technical ideas that can be acquired from the above-described embodiments and the modified examples will be described.

(1) In the above-described recording apparatus, the above-described control unit adjusts the amount of the airflow blown by the cooling unit in accordance with the detected temperature that is detected by the temperature detecting unit.

(2) In the above-described recording apparatus, the second cooling unit is a unit that takes heat away from the above-described cooling unit, a driving source (66) that can adjust the amount of heat to be taken away from the cooling unit in accordance with the driving speed is further included, and the control unit controls the driving speed of the driving source in accordance with the detected temperature that is detected by the temperature detecting unit.

(3) In the above-described technical idea (2), the second cooling unit is configured to adjust the amount of flow of the refrigerant that cools the cooling unit in accordance with the driving speed of the driving source.

(4) In the above-described recording apparatus, the cooling unit is a roller that can be rolled while being brought into contact with the transport belt.

(5) In the above-described recording apparatus, a plurality of the record heads is disposed in the transport direction of the transport belt, and the cooling unit is disposed so as to cool an area of the transport belt corresponding to an area between the record heads.

(6) In the above-described recording apparatus, the cooling unit is configured such that a refrigerant passes through the inside thereof.

(7) The above-described recording apparatus further including a second cooling unit that takes heat away from the cooling unit by being brought into contact with the cooling unit.

(8) In the above-described recording apparatus, a first temperature detecting unit (32) that detects the temperature of a heated portion of the transport belt and a second temperature detecting unit (33) that detects the temperature of a portion, which is forcedly cooled, of the transport belt are included. The control unit controls the heating unit based on the detected temperature, which is detected by the first temperature detecting unit, in accordance with a setting for which the heating unit can supply heat needed for enhancing the print image quality to a printing medium as a target. In addition, the control unit controls the cooling unit based on the detected temperature, which is detected by the second temperature detecting unit, in accordance with a setting for which the transport belt can be cooled up to a temperature not having a bad effect on the downstream record head.

What is claimed is:

1. A recording apparatus comprising:

a transport belt that transports a target in a transport direction;

a record head that performs recording by adhering liquid to the target that is loaded on the transport belt so as to be transported;

a heating unit that heats the transport belt and that generates heat to accelerate drying the liquid that is recorded on the target by the record head, the heating unit located on a downstream side of the record head in the transport direction;

a cooling unit that forcedly cools a portion of the transport belt that is heated by the heating unit before the portion of the transport belt moves to a position corresponding to the record head;

a detection unit that detects transport of the target toward a cooling target position of the cooling unit in advance; and a control unit that controls the cooling unit such that a cooling operation is performed by the cooling unit during a period in which the transport of the target is not detected based on the result of detection of the detection unit and the cooling operation of the cooling unit is stopped at least before the target arrives at the cooling target position for a case where the transport of the target is detected based on the result of detection of the detection unit.

2. The recording apparatus according to claim 1, further comprising:

a temperature detecting unit that detects a temperature of the heated portion of the transport belt; and a control unit that adjusts cooling power of the cooling unit in accordance with a detected temperature detected by the temperature detecting unit.

3. The recording apparatus according to claim 1, wherein the cooling unit is an airflow blowing unit that performs a cooling operation by blowing airflow to the transport belt and stops the cooling operation by stopping blowing the airflow to the transport belt.

4. The recording apparatus according to claim 1, wherein the cooling unit is a contact-type cooling unit that performs a cooling operation by being brought into contact with the transport belt and stops the cooling operation by being separated from the transport belt.

5. The recording apparatus according to claim 1, further comprising another record head located downstream of the cooling unit.

6. The recording apparatus according to claim 2, further comprising a second cooling unit that cools the cooling unit, wherein the control unit adjusts the cooling power of the cooling unit by controlling the second cooling unit based on the result of detection of the temperature detecting unit.

7. The recording apparatus according to claim 4, further comprising a drive unit that drives the cooling unit to be contacted with or separated from the transport belt, wherein the control unit controls driving of the drive unit such that the cooling unit is brought into contact with the transport belt for performing the cooling operation, and the cooling unit is separated from the transport belt for stopping the cooling operation.

8. A method of adjusting a temperature of a transport belt of a recording apparatus including a record head that performs recording by adhering liquid to a target that is transported by the transport belt in a transport direction, the method comprising:

heating the transport belt with a heating unit so as to accelerate drying the liquid that is recorded on the target by the record head, the heating unit located downstream of the record head in the transport direction; and lowering the temperature of the transport belt that rises in the heating of the transport belt in advance before a heated portion of the transport belt arrives at a position corresponding to the record head, the position being a cooling target position, by forcedly cooling with a cooling unit the heated portion of the transport belt before the heated portion of the transport belt moves to a position corresponding to the record head;

detecting by a detection unit transport of the target toward a cooling target position of the cooling unit; and controlling the cooling unit with a controller such that a cooling operation is performed by the cooling unit during a period in which the transport of the target is not detected based on the result of detection of the detection unit and the cooling operation of the cooling unit is stopped at least before the target arrives at the cooling target position for a case where the transport of the target is detected based on the result of detection of the detection unit.

* * * * *